US007320269B2

(12) United States Patent
Achelpohl

(10) Patent No.: US 7,320,269 B2
(45) Date of Patent: Jan. 22, 2008

(54) BLADE SLIT COVERING ON A CUTTING AND FEED ROLLER

(75) Inventor: Fritz Achelpohl, Lienen (DE)

(73) Assignee: Windmoeller & Hoelscher KG, Lengerich (DE)

( * ) Notice: Subject to any disclaimer, the term of this patent is extended or adjusted under 35 U.S.C. 154(b) by 344 days.

(21) Appl. No.: 10/491,341

(22) PCT Filed: Dec. 19, 2001

(86) PCT No.: PCT/EP01/15090

§ 371 (c)(1),
(2), (4) Date: Apr. 1, 2004

(87) PCT Pub. No.: WO03/051588

PCT Pub. Date: Jun. 26, 2003

(65) Prior Publication Data

US 2004/0194596 A1 Oct. 7, 2004

(51) Int. Cl.
*B26D 5/12* (2006.01)

(52) U.S. Cl. ..... 83/304; 83/659; 83/544

(58) Field of Classification Search ..... 83/304, 83/284, 544, 659, 677, 331, 129–131, 137; 30/164

See application file for complete search history.

(56) References Cited

U.S. PATENT DOCUMENTS

| | | | | |
|---|---|---|---|---|
| 332,519 | A * | 12/1885 | Hawkins | 101/222 |
| 3,130,886 | A | 4/1964 | Staaf et al. | |
| 4,009,626 | A | 3/1977 | Gressman | |
| 4,998,350 | A * | 3/1991 | Thompson | 30/151 |
| 5,464,166 | A | 11/1995 | Kirkpatrick, III et al. | |
| 5,964,975 | A * | 10/1999 | Hinton | 156/215 |
| 6,553,883 | B1 * | 4/2003 | Adami | 83/508.1 |
| 6,766,722 | B2 * | 7/2004 | Plasswich | 83/304 |
| 2002/0066347 | A1 * | 6/2002 | Plasswich | 83/338 |

FOREIGN PATENT DOCUMENTS

| | | |
|---|---|---|
| EP | 0 698 571 A2 | 2/1996 |
| JP | 5 716 6267 A | 10/1982 |
| WO | WO 99/43475 A1 | 9/1999 |
| WO | WO 01/03913 A1 | 1/2001 |

* cited by examiner

*Primary Examiner*—Boyer D. Ashley
*Assistant Examiner*—Sean Michalski
(74) *Attorney, Agent, or Firm*—Jacobson Holman PLLC

(57) ABSTRACT

A material cutting and feed roller has a peripheral roller surface that conveys the material to be cut, and a cutting device within the roller that cuts the material. The cutting device has a blade that, when cutting the material, passes through a closeable opening located inside the peripheral surface of the roller. The closeable opening through which the blade passes during the cutting process is closed when the cutting process is not occurring.

13 Claims, 4 Drawing Sheets

BLADE SLIT COVERING ON A CUTTING AND FEED ROLLER

This is a nationalization of PCT/EP01/15090 filed Dec. 19, 2001 and published in German.

BACKGROUND OF THE INVENTION

1. Field of the Invention

The invention relates to a blade slit covering on a cutting and feed roller of a material winder. The roller carries webs of material, and the outer lateral surface of the roller has a slit-shaped opening through which a cutting device can cut the webs of material.

2. Description of the Prior Art

Cutting and feed rollers of the previously mentioned type are already known. EP 0 698 571 illustrates such a cutting and feed roller. A blade, which is initially located within the lateral surface, is characteristic for rollers of this type.

During the cutting process, the blade passes through a usually slit-shaped opening located inside the lateral surface of the cutting and feed roller, thus, in this manner, cutting the webs of material that rest upon the lateral surface of the feed roller.

The said webs of material can be damaged, however, if they contact the slit-shaped opening.

It is therefore the task of the invention to reduce or completely avoid the occurring damage.

SUMMARY OF THE INVENTION

The task is therefore solved in that the slit-shaped opening of the lateral surface of the feed roller is closed, when the blade is located in its position of rest inside of the roller.

It is particularly advantageous if the closure of the blade in its position of rest forms a part of the peripheral surface of the feed roller.

In this regard, it must be reiterated that the closure of the slit-shaped opening, which is hereinafter also referred to as a blade passage slit, may be performed by all kinds of mechanical devices suitable for this purpose. The description and patent claims list hoses, dampers, and sliders as examples.

It is also advantageous to equip a cutting and feed roller according to the invention with suction or vacuum devices, such as the ones shown in the previously mentioned application.

Additional details and advantageous embodiments of the invention can be found in the following graphic description, and in the sub-claims.

Figure 3:
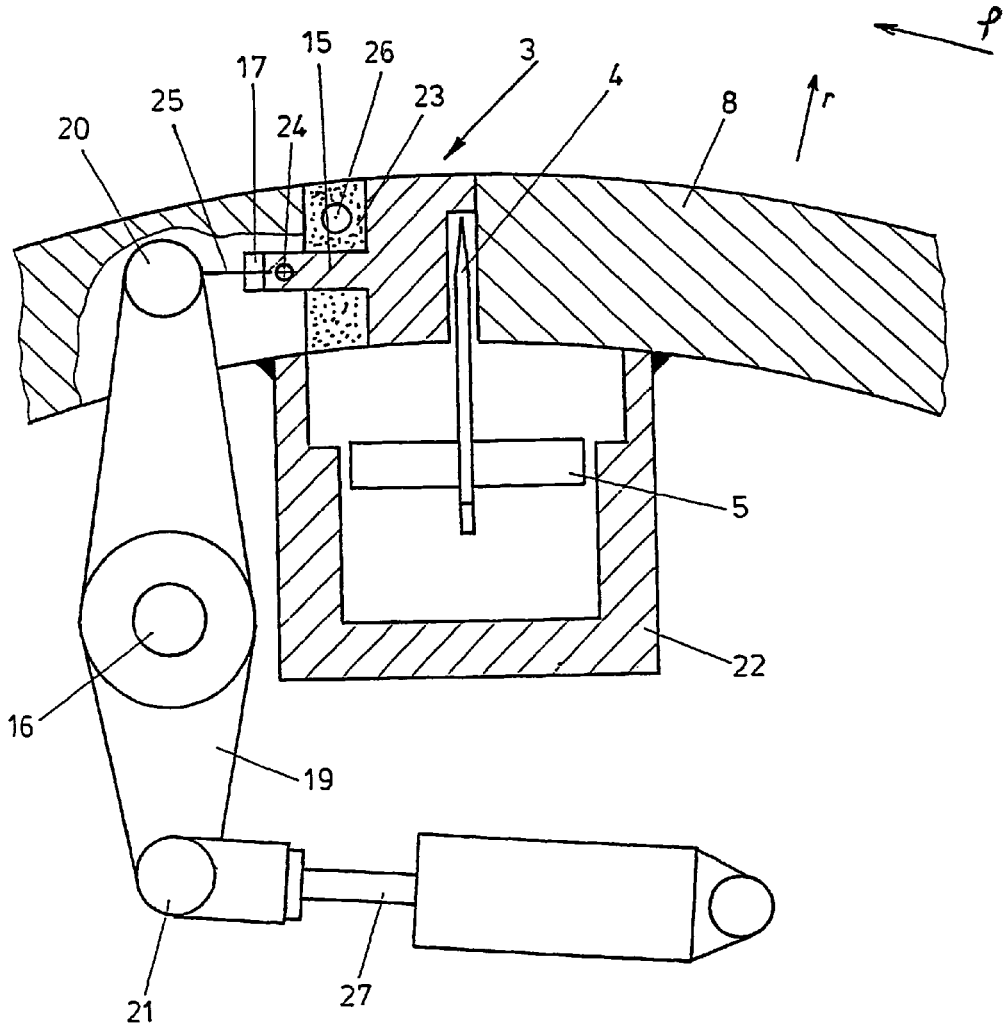

In the embodiment example illustrated in FIG. 3, the blade passage slit is closed by means of a slider.

Figure 4:
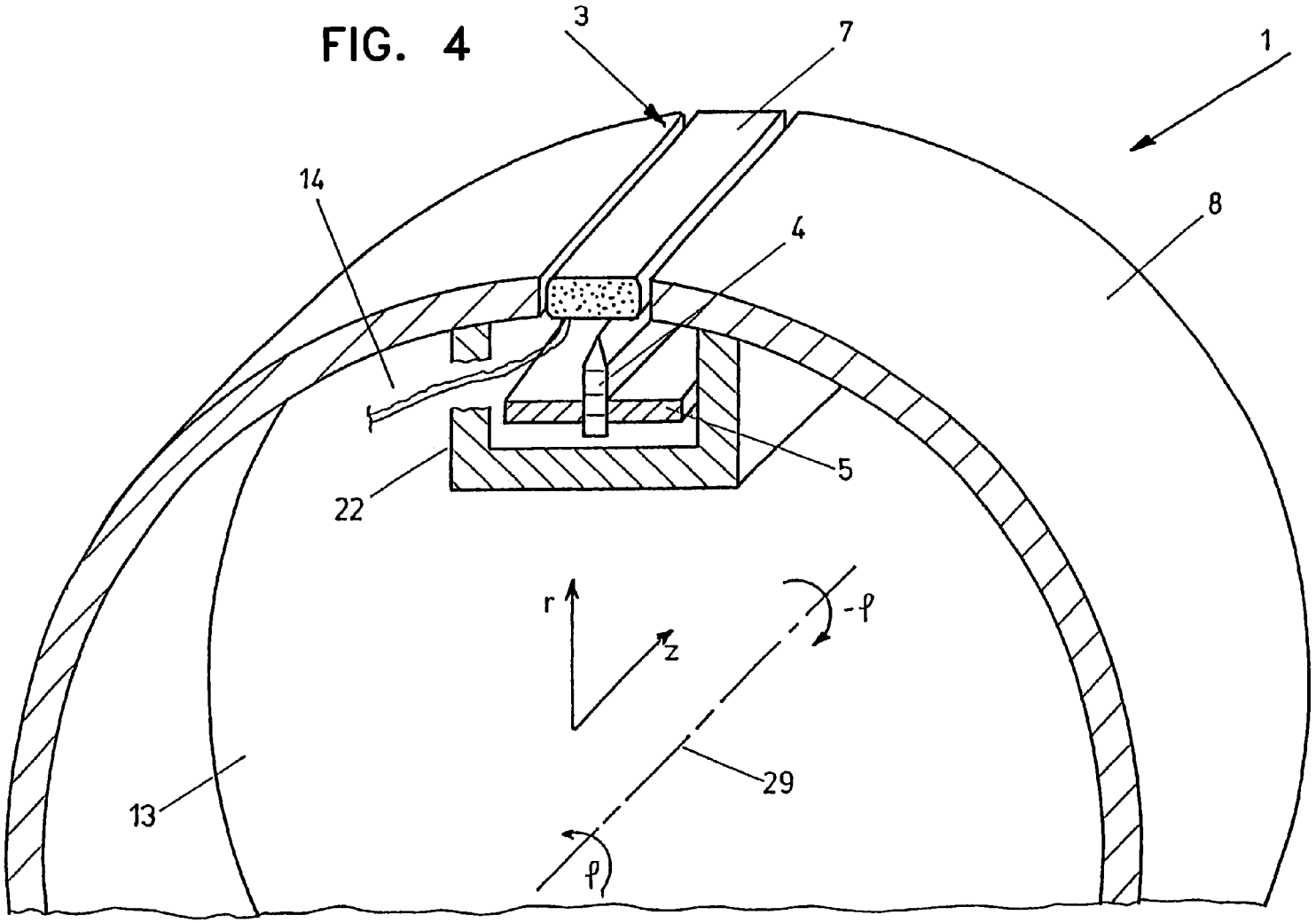

FIG. 4 FIG. 4 outlines a section through a roller according to the invention.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
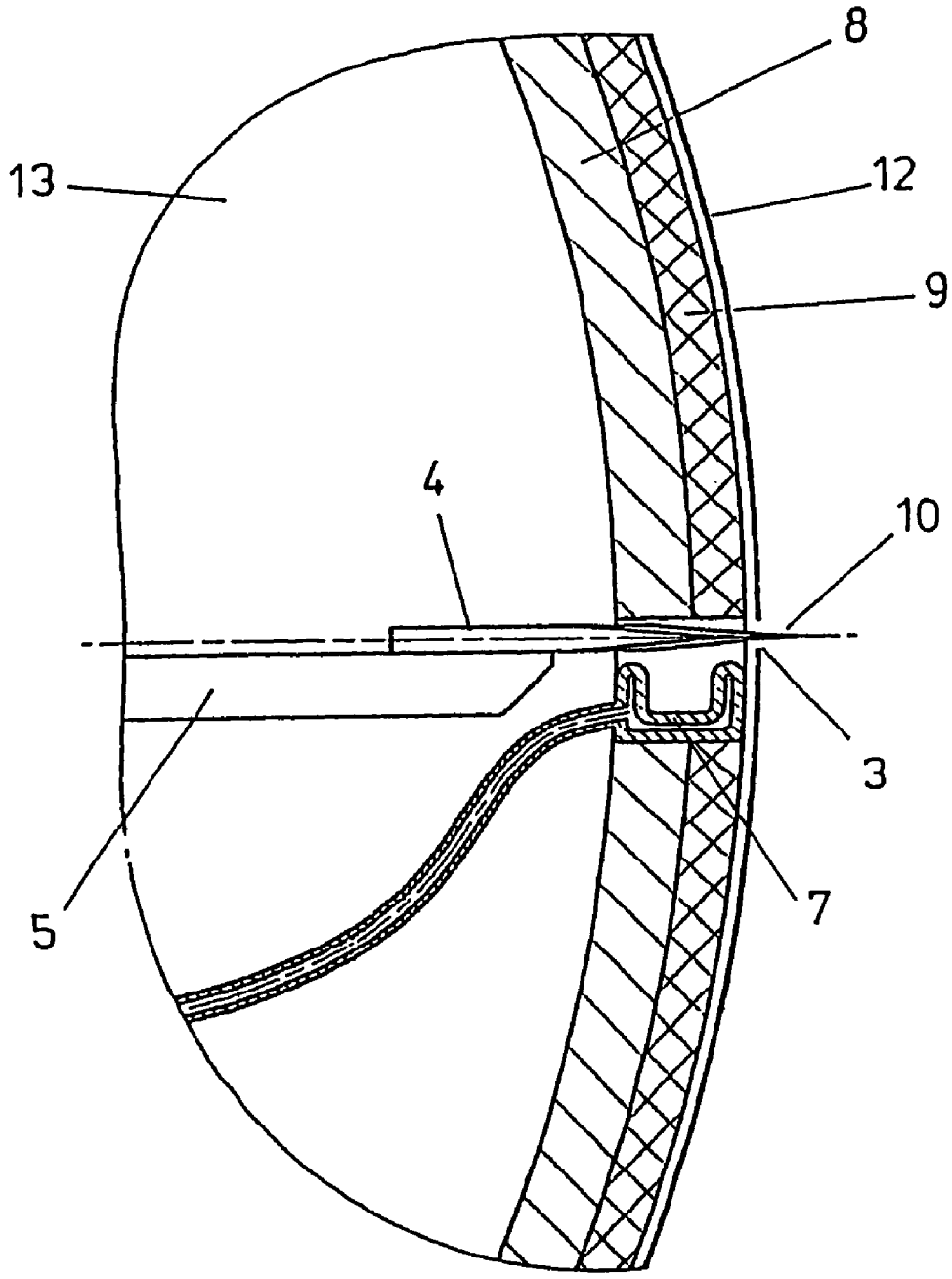
FIG. 1 shows a section through the area of a web guide roller according to the invention, in which the cutting process is occurring. In this embodiment example, the blade passage slit can be closed with the aid of a hose. However, in FIG. 1, the web is cut straight.
Figure 2:
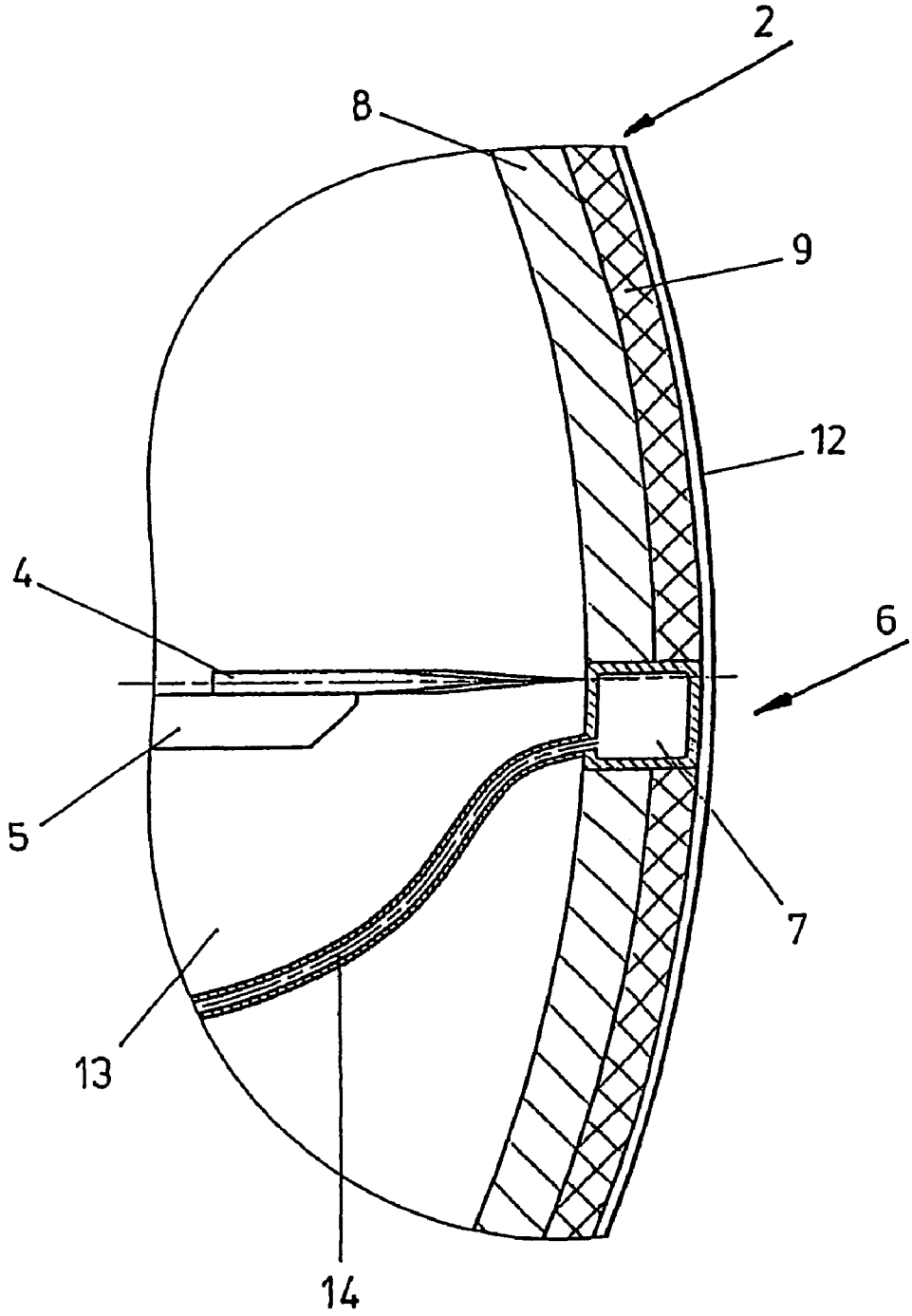
FIG. 2 FIG. 2 shows a section through the same area of the same embodiment example, whereby the blade is located inside of the web guide roller.

FIG. 1 shows a section through the area of a web guide roller 1 according to the invention in which the cutting process is occurring. In order to make it possible for the blade 4, which is carried and moved by a blade carrier 5, to pass through the outer surface 2, the outer surface comprises a blade passage slit 3. In the embodiment example shown, the outer surface 3 is made of a steel construction 8 and comprises a rubber facing 9. The cutting edge 10 of the blade 4 protrudes in radial direction beyond the peripheral surface 11 of the web guide roller, and cuts through the sheet 12. In the embodiment example shown, the web guide roller comprises frontal coverings, one of which can be seen in the figure.

An inflatable hose 7, which is not inflated in FIG. 1, and which enables the blade 4 to pass through the blade slit is located inside of the blade slit.

If necessary, several hoses, which operate successively in, for example, axial direction (z) of the roller may be installed in the blade passage slit 3.

FIG. 3 again schematically shows a device according to the invention, in which a slider 15 closes the slit-shaped opening 3 in the roller surface. The slider 15 possesses a projection 24, which is able to glide with little clearance in the feed notch 17, which is located in the surface of the roller. In this manner, the slider is retained and guided. The projection 24 is articulated on the pull and push rod 25. The pull/push rod on its part is connected to the lever 19 with its articulation 20. The lever 19 is attached to the center of rotation 16. Furthermore, the lever is connected to the piston 27 of the pneumatic cylinder 28 by means of the articulation 21.

In the device according to the description, the pneumatic cylinder 28 transfers a force to the slider 15 by means of its piston, 27, the lever 19, and the pull/push rod 25, and opens and closes the blade slit 3 in this manner.

In order not to allow an opening relative to the surface 8 despite of the translation of the slider 15, a buffer made of flexible material 23, such as rubber, is provided between the slider and the lateral surface in the embodiment example shown. If necessary, such a buffer may contain hollow spaces, or recesses 26, respectively, in order not to protrude beyond its bulge past the steel construction of the roller in radial direction.

The entire cutting or blade guide mechanism of the cutting and feed roller is not the subject of the invention at hand, and is therefore only schematically outlined at this point.

Therefore, only the box of the cutting device 22, which is attached to the steel construction 8 of the roller, as well as the blade 4 and the blade carrier 5, are illustrated. Any devices providing the force or the torque necessary during the cutting process, and which ensure that at least one blade protrudes through the blade slit 3 in radial direction beyond the steel construction 8 during the cutting process, are not illustrated in FIG. 3.

FIG. 4 serves for the total overview of a cutting and feed roller 1 according to the invention, which is not illustrated herein. Again, as with FIG. 3 the actual cutting mechanism is merely schematically outlined by means of the box of the cutting device 22, the blade 4, and the blade carrier 5.

In the embodiment example illustrated in the figure, the blade slit 3 is again closed by means of a hose 7. The hose 7 can be inflated or deflated by means of the flexible feed line 14. Any devices supplying the air pressure necessary for this, or which lead into the interior of the roller, are also known, and are therefore not shown at this point.

Also shown in the background is the frontal covering 13 of the roller, which usually limits the roller interior in the case of feed rollers according to prior art.

The roller can rotate around the roller axis 29 in both directions, which is indicated by the bent arrows f and –f, which also state the direction of the angle coordinate to be used with the description. The angle coordinates f, together with the radial r and axial z coordinates also shown by means of the coordinate cross, a cylinder coordinate system, which has already been used in the application at hand for purposes of description.

For illustration purposes, drawing FIG. 4 omits the illustration of a film to be cut.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| Reference Chart | |
|---|---|
| Web guide roller | 1 |
| Outer surface | 2 |
| Blade passage slit | 3 |
| Blade | 4 |
| Blade carrier | 5 |
| Closure | 6 |
| Hose | 7 |
| Lateral surface of roller | 8 |
| Rubber facing of roller | 9 |
| Cutting edge of blade | 10 |
| | 11 |
| Web of material | 12 |
| Frontal covering | 13 |
| Flexible feed line | 14 |
| Slider | 15 |
| Center of rotation of lever | 16 |
| Feed notch | 17 |
| Pneumatic cylinder | 18 |
| Lever | 19 |
| Articulation of pull/push rod | 20 |
| Articulation of the lever on the piston | 21 |
| Box of cutting device | 22 |
| Buffer made of flexible material | 23 |
| Projection of slider | 24 |
| Pull/push rod | 25 |
| Recess in flexible material | 26 |
| Piston | 27 |
| Pneumatic cylinder | 28 |
| Pivot axis of roller | 29 |
| Radial coordinates | (r) |
| Axial coordinates | (z) |
| Angle coordinates | (f) |
| Bent arrow in negative pivoting direction | (–f) |

What is claimed is:

1. A cutting and feed roller comprising:

a peripheral roller surface that conveys thereon a material to be cut, the roller surface having therein a closeable slit-shaped opening;

cutting device that cuts the material, the cutting device including a blade carrier having attached thereto at least one blade having at least one cutting edge, the blade carrier being configured to insert the cutting edge of the blade through the slit-shaped opening when it is open; and an inflatable hose attached to the roller in an area of the slit-shaped opening that closes the slit-shaped opening.

2. The cutting and feed roller according to claim 1, wherein the slit-shaped opening is in a closed position when the material is being conveyed on the roller.

3. The cutting and feed roller according to claim 1, wherein closure of the slit-shaped opening forms a portion of the roller peripheral surface.

4. The cutting and feed roller according to claim 1, wherein the hose is connected to a central pressurized air supply by at least one flexible line.

5. The cutting and feed roller according to claim 1, wherein the hose is connected both to an air pressure line and to a vacuum line, and further comprising valves that enable an alternating release of the air pressure and vacuum lines.

6. The cutting and feed roller according to claim 1, further comprising a vacuum source located in an interior of the roller, the vacuum source including connections to the slit-shaped opening.

7. The cutting and feed roller according to claim 1, wherein the blade protrudes through the slit-shaped opening in a radial direction beyond the peripheral roller surface.

8. The cutting and feed roller according to claim 3, wherein the inflatable hose forms the portion of the roller peripheral surface.

9. The cutting and feed roller according to claim 1, wherein the inflated hose expands so as to close the slit-shaped opening.

10. A cutting and feed roller comprising:

a peripheral roller surface that conveys thereon a material to be cut, a portion of the roller surface having therein a closeable slit-shaped opening;

a cutting device that cuts the material, the cutting device being housed within the roller and including a blade carrier having attached thereto a blade having at least one cutting edge, the blade carrier being configured to insert the cutting edge of the blade through the slit-shaped opening when it is open; and an inflatable hose housed within the roller, the hose being configured to inflate so as to close the slit-shaped opening and to deflate so as to open the slit-shaped opening.

11. The cutting and feed roller according to claim 10, wherein closure of the slit-shaped opening forms a portion of the roller peripheral surface.

12. The cutting and feed roller according to claim 10, wherein the slit-shaped opening is closed with at least one inflatable hose attached to the roller in an area of the slit-shaped opening.

13. The cutting and feed roller according to claim 12, wherein the hose is connected to a central pressurized air supply by a flexible line.

* * * * *